United States Patent [19]

Hockham et al.

[11] 4,222,055

[45] Sep. 9, 1980

[54] AROUND-THE-MAST ROTARY COUPLER

[75] Inventors: George A. Hockham, Valencia; Ronald I. Wolfson, Northridge, both of Calif.

[73] Assignee: International Telephone and Telegraph Corporation, New York, N.Y.

[21] Appl. No.: 40,325

[22] Filed: May 18, 1979

[51] Int. Cl.[2] ..... H01Q 3/02; H01P 1/06

[52] U.S. Cl. ..... 343/762; 343/890; 333/261

[58] Field of Search ..... 343/709, 710, 761, 762, 343/763, 854, 890, 891; 333/261

[56] References Cited

U.S. PATENT DOCUMENTS 3,546,699 12/1970 Smith ..... 343/762

*Primary Examiner*—Eli Lieberman

*Attorney, Agent, or Firm*—William T. O'Neil

[57] ABSTRACT

An annular rotary RF coupler for installation about a vertical support structure, particularly the mast of a ship. Two annular troughs are regularly divided in circumferential increments providing a cellular structure of individual waveguide cross-sections. A lower annulus remains fixed, the individual waveguide sections therein being fed from a power-divided, equal-phase, feed configuration. The oppositely facing upper annulus rotates with respect to the lower one about a common mechanical center of rotation of a mechanically rotating antenna system. Connection to the rotating waveguide sections may be through power combiner/divider means, or individual subarrays may be discretely connected to one or more waveguide sections in the rotating annulus. For power tapering across an antenna array aperture, the waveguide section dimensions in the circumferential direction within the rotating annulus are appropriately tailored.

10 Claims, 9 Drawing Figures

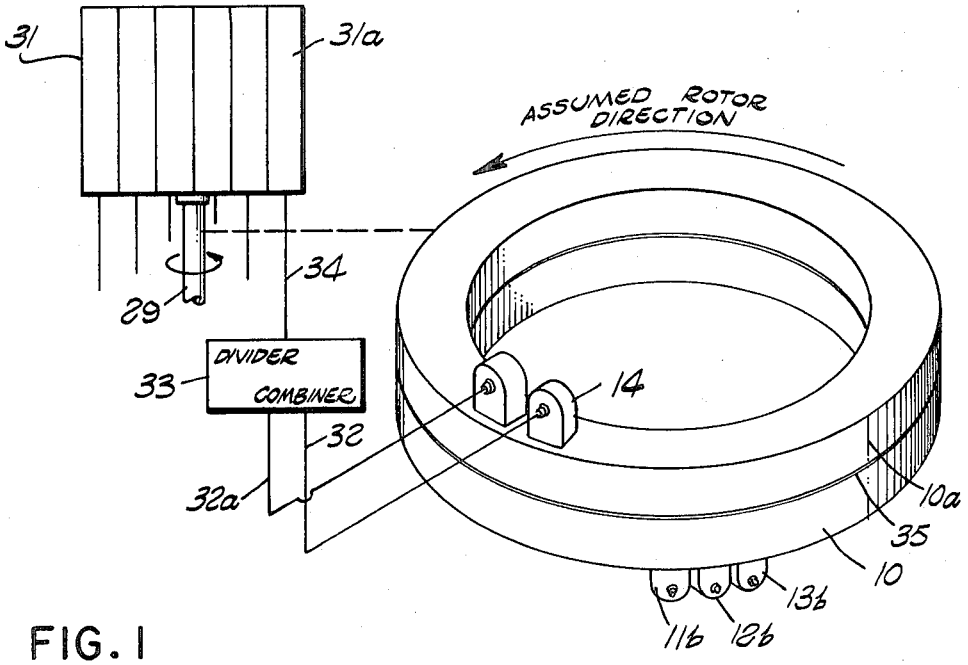
FIG. 1
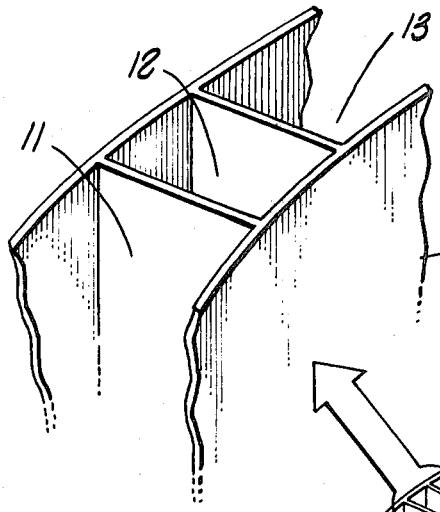
FIG. 2a
FIG. 2
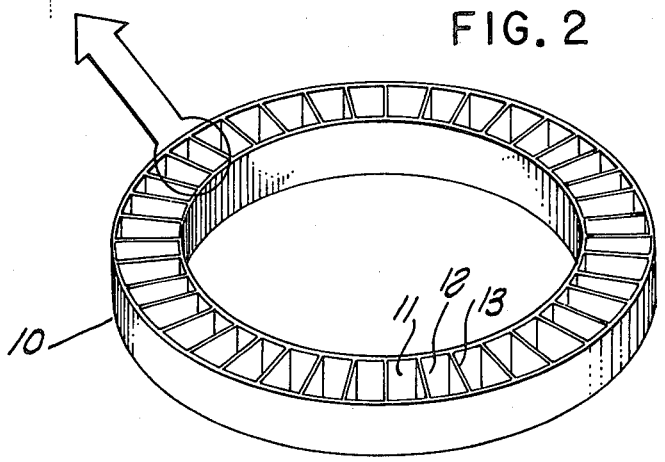

AROUND-THE-MAST ROTARY COUPLER

BACKGROUND OF THE INVENTION

1. Field of the Invention

The invention relates to radar antenna systems and more particularly to rotating couples to accommotate antenna mechanical rotation.

2. Description of the Prior Art

In the prior art rotating RF couplings have been provided in a number of forms. A brief summary of their use is contained in the test Radar Handbook by Merrill I. Skolnik (McGraw-Hill 1970) in Chapter 8 under a paragraph entitled "Rotary Joints." Bibliographical references concerning the theory and design of rotary joints are contained in that summary.

The patent literature also includes description of prior art devices of conventional type, such as the apparatus of U.S. Pat. No. 2,751,559, for example.

In U.S. Pat. No. 3,896,446, a rotating RF joint is involved in a scanning radar system in which the antenna system is mounted over the top of a helicopter rotor to rotate with it, however, no advances in the rotary joint itself appear to be disclosed.

Other rotary RF joints, such as shown in U.S. Pat. No. 3,123,782 appear to be based on conductive circular ring arrangements and as such may be thought of as "slip-ring" devices.

Still further, systems not including sliding contacts but providing electromagnetic energy transfer in a rotating joint include multihorn configurations and the like. U.S. Pat. No. 3,803,619, and also U.S. Pat. Nos. 3,117,291 and 3,108,235 disclose devices of that type.

The slip-ring systems present well-known arcing, mechanical wear, and other problems, and the rotating horn devices are complex and costly, and also leave much to be desired in energy transfer efficiency.

In the most familiar shipboard rotating antenna installations, lateral structural members affixed to mast structures have been required. Prior art rotary joints of the aforementioned and other conventional types have been applied in such instances. Many have used such expedients as circular waveguide, coaxial transmission line sections and the like providing rotatable conductive walls essentially concentric with the axis of rotation of the antenna structure itself.

The manner in which the invention advances the art relating RF (microwave) rotary joints will be understood as this description proceeds.

SUMMARY

The invention includes a pair of facing annular rings each divided into cells producing a series of circumferentially disposed waveguide sections. The cross-sections of these waveguides are in planes normal to the axis of the two annulus subassemblies. One annular ring is fixed (stator) and the other rotates (rotor) in fixed mechanical relationship with a rotating antenna array.

The individual waveguides of the stator are normally fed from a divider/combiner connected to transmit/-receive equipment. The same arrangement may be applied between rotor and array, however, since such arrays are normally composed of a plurality of linear subarrays (columns of radiators), an attractive alternative suggests itself, namely that the individual waveguide sections of the rotor may be discretely connected to corresponding ones of those linear subarrays, the inherent divider/combiner function of the annular rotary joint of the invention being thereby exploited. Where more waveguide sections than linear subarrays are extant, minimal recombination can be employed. Thus the requirement with most prior art rotating joints for multi-port division/combination between the rotor and the array is eliminated.

Still further, by tailoring the rotor waveguide circumferential dimensions, power tapering over the array aperture can be achieved simply. The reasons for power tapering are well understood by those of skill in this art.

The details of a typical embodiment, and variations therein will be understood as this description proceeds.

BRIEF DESCRIPTION OF THE DRAWINGS

FIG. 1 is a partially pictorial representation of an annular rotary joint system according to the invention.

FIG. 2 is a simplified pictorial representation of the stator portion of a rotating joint of annular type according to the invention.

FIG. 2*a* is a magnified view of a portion of FIG. 2.

DETAILED DESCRIPTION OF THE DRAWINGS

Figure 3:
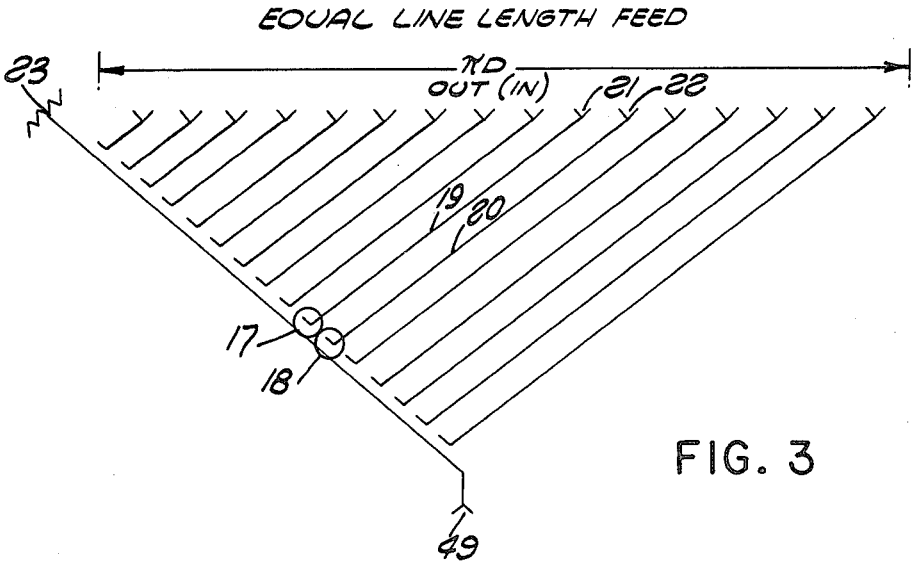
FIG. 3 is a schematic diagram of an equal-line-length feed arrangement for the rotary joint of the invention.

Referring now to FIG. 1, an annular rotary joint according to the invention is shown connected to a typical antenna array 31. The annular rotary joint comprises stator portion 10 which is fixed and connected by means of other apparatus to a transmit/receive equipment location. The rotor portion 10*a* rotates about the common center it has with the stator 10. A mast or other vertical support structure should be understood to pass through the open circular center space within 10 and 10*a*. An array such as 31 would typically be mounted with conventional mechanical rotational drive at the top of such a mast, the drive producing a slaved-mechanical rotation of 10*a*. Those mechanical details are conventional, and need not be included within the inventive combination. It will be quite evident, however, that the configuration of FIG. 1 provides the capability of disposing an RF rotary joint around the outside perimter of a mast, unlike prior art situations in which a lateral arm has been required for the mounting of a rotating antenna array spaced away from the mast of the vessel.

Through use of the present invention, the rotating array can sit atop the mast structure or can be mounted to trace a circular path about the mast with the array boresite always radially outward. In this way, the blockage and radiation pattern distortion resulting from the presence of the mast structure directly in front of the array at a particular angle is, eliminated.

The rotor and stator subassemblies of FIG. 1, namely 10*a* and 10 respectively, have an annular interface generally represented at 35 on FIG. 1. Further description of the remaining elements depicted in FIG. 1 await the description of other figures herewith, in order that the nature of these waveguide annular subassemblies 10 and 10*a* can first be described.

Referring now to FIG. 2, stator 10 is depicted independently with 10*a* absent. It will be seen that the annulus is divided into individual waveguide cells or sections typically 11, 12 and 13. FIG. 2*a* is an expanded section showing these three particular waveguide sections in abutting positions so that the radially extending separating walls are common walls between adjacent waveguide sections.

Although it would theoretically be possible to orient these typical waveguide sections such as 11, 12 or 13 with radially extending narrow walls and circumferentially measured broad walls, it is considered preferable and more convenient from a feed standpoint to have these individual cells oriented with broad waveguide walls extending radially and narrow walls orthogonal thereto. Since it is contemplated that the annular rotating joint or coupler according to the invention would be used on major ocean-going vessels, the mast they surround would be of substantial size and, therefore, the diameter of the rotor/stator assembly of 10*a* and 10 is relatively large. Accordingly, a fairly large number of waveguide sections or cells such as 11, 12 and 13 are required about the relatively large circumference involved. Accordingly, S or L band waveguide sections are relatively small in comparison, and therefore, although each of these waveguide sections is approximately trapezoidal in shape, the variation from rectangular is very small and not of great electrical significance as long as the radial walls are precisely radial. The waveguide sections are actually segments of an annulus.

The individual waveguide sections such as 11, 12 and 13 operate in the $TE_{10}$ mode and accordingly, there are no RF currents of substantial magnitude between rotor and stator at the interface 35.

Figure 4:
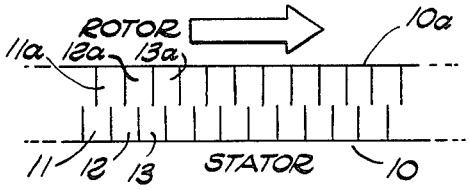
FIG. 4 illustrates a cutaway view of the stator of FIG. 2 with a matching rotor associated therewith.
Figure 5A:
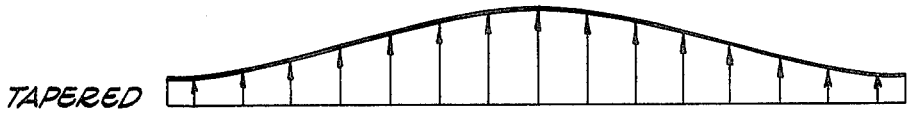
FIG. 5*a* is a diagram of the tapered excitation program obtainable with the variation illustrated in FIG. 5.
Figure 5:
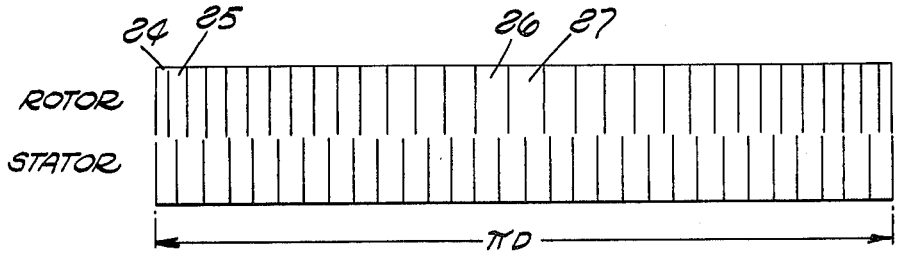
FIG. 5 is a view taken like FIG. 4 except that the individual waveguide sections of the rotor are tapered in width.

Looking ahead to FIG. 4, a cross-sectional view of the rotor and stator 10*a* and 10 is illustrated; in which the instantaneous rotational relative positions of 10 and 10*a* is such that the radially extending walls of the rotor or stator sections bisect the circumferential dimensions of the waveguide sections of the other. This situation is illustrated in FIG. 4, where waveguide sections 11*a*, 12*a*, and 13*a* are shown associated with sections 11, 12 and 13 of the rotor and stator respectively. The effect of this relative positioning or any positioning other than congruence on a one-for-one bases of rotor and stator waveguide sections is to divide the power transferred from a given waveguide section (of the stator, for example) between two adjoining waveguide sections of the rotor.

Figure 7:
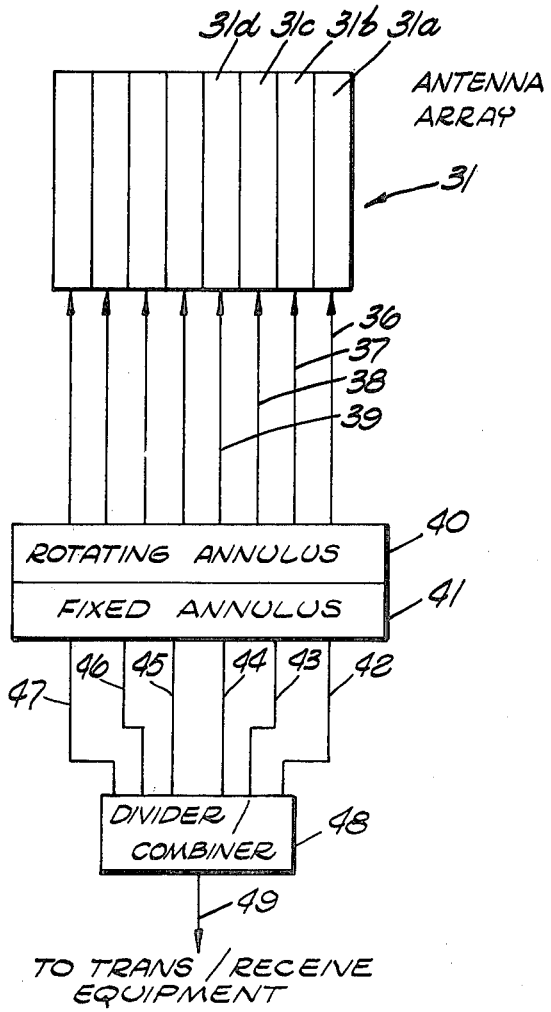
FIG. 7 is a block diagram illustrating a form of integral combiner/divider feed employing the annular rotating joint according to the invention.

Looking ahead to FIG. 7, the question of feed arrangements for the rotor and stator subassemblies of FIGS. 1 and 4 can be addressed generally before the so-called equal-line-length feed configuration of FIG. 3 is described. In FIG. 7, a fixed annulus or stator 41 and rotating annulus or rotor 40 are shown, it being understood that these are essentially the same as 10 and 10*a* of FIGS. 1 and 4, respectively.

Wherever an array such as 31 comprises a plurality of rows or columns of radiating elements such as 31*a*, 31*b*, 31*c*, and 31*d*, some type of power dividing arrangement is normally provided between these and a single-channel rotating joint in a prior art arrangement.

In addition to providing the around-the-mast capability, the present invention also has a corollary advantage in that it provides for inherent power division. Accordingly, separate transmission lines 36, 37, 38 and 39 can provide discrete feed for the rows or columns of radiators 31*a* through 31*d* aforementioned. These transmission lines 36 through 39 can be discretely connected from one or a small fraction of the waveguide sections distributed about the rotating annulus (rotor) 40.

From the transmit/receive equipment via lead 49, a divider/combiner 48 is required to discretely feed the waveguide sections of the stator 41. For this purpose, a simplified situation in which six combinations/divisions are effected in 48 via leads 42, 43, 44, 45, 46 and 47, is depicted. From the description hereinbefore, however, it will be obvious that many more leads between the divider/combiner and the stator 41 would be the normal situation, accordingly, a divider/combiner of the type described in U.S. Patent application Ser. No. 019,481, filed Mar. 12, 1979, entitled "Large Scale Low-Loss Combiner and Divider" might advantageously be employed. That patent application is assigned to the assignee of this application.

It is also possible to stage the division and combining, i.e., by providing additional combiner/dividers responsive to the individual leads 42 through 47, each having a second plurality of input/output leads such that a larger number of discrete feed connections for each of the waveguide sections of 41 could be obtained from a single lead 49.

In FIG. 1, an example of combination from a pair of waveguide sections of the rotor via leads 32 and 32*a* in a combiner/divider 33 produces a column excitation lead 34 applicable to radiator column 31*a* in array 31. It should also be noted that in FIG. 1 the mechanical rotating drive is represented at 29 functioning as hereinbefore indicated.

Figure 6:
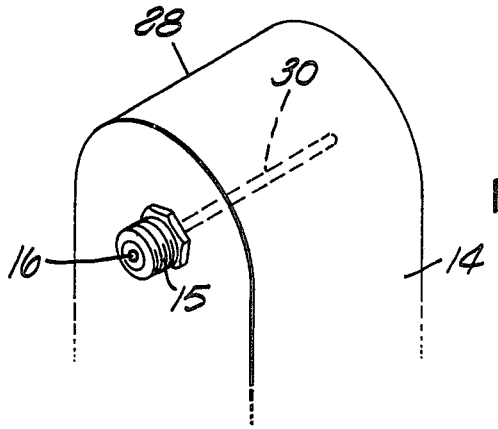
FIG. 6 is a partially-cutaway coaxial-cable to waveguide transition applicable to FIG. 4.

Referring now to FIG. 6, the transition of a signal typically from coaxial cable, at a connector having an outer conductor 15 and an inner conductor 16 involves a probe 30 within the domed end 28 of a particular waveguide section identified as 14. The dome section 28 is radiused uniformerly in accordance with known techniques and probe 30 provides coupling between the $TE_{10}$ waveguide mode and a coaxial cable connected thereto. A particular waveguide section 14 is referred to although it is to be understood that any of the rotor or stator waveguide sections would be similarly treated. This applies to typical stator ports 11*b*, 12*b* and 13*b*.

Each waveguide section about the rotor and stator annulus is to be understood to include the structure of FIG. 6. In lieu of the probe 30 a stepped transition center conductor can be substituted, this being a conventional technique well understood by those skilled in this art.

Although there is no serious electrical reasons for chokes or other elaborate electrical protection at the interface 35 (FIG. 1), an environmental cover is obviously necessary. This can be produced by any known mechanical expedient which would be conventional under the circumstances.

Returning now to FIG. 3, an equal line length feed is illustrated for application particularly to the stator feed situation. Lead 49 extends into a stripline or high powered coaxial line including a series of couplers, for example, of the three port type as illustrated. Either the terminating resistor 23 or a direct connection to the last cell is conventional in such an arrangement. Two of these three-port couplers are represented at 17 and 18, feeding lines 19 and 20 respectively, to corresponding ports 21 and 22 which would be, for example, one of those illustrated in FIG. 1 at 11*b*, 12*b* and 13*b*. In the arrangement of FIG. 3 the most significant fact is that for any path length from 49 to any of the out/in ports such as 21 and 22, for example, the line length is equal. Accordingly, equal phase and power excitation is provided for each of the stator waveguide sections thus fed discretely. Of course, tapered coupling may also be achieved in the rotor if desired.

As a variation, and in fact preferred for better isolation and consequent minimization of in-band reflections from the coupled arms back into the feed line, is the four-port coupler (directional coupler). The additional port would be resistively terminated at each location, such as 17 or 18, in a manner understood by those of skill in this art.

Modifications and variations will suggest themselves to those skilled in this art once the principles of the present invention are thoroughly understood. Accordingly, it is not intended that the scope of the invention should be regarded as limited to the drawings or this description, these being typical and illustrative only.

What is claimed is:

1. A rotary radio-frequency power coupler for an antenna array rotatable with respect to a generally vertical support structure, the center of rotation of said array falling within the perimeter of said support structure at least at and adjacent to the mounting location of said array, comprising:

first and second annular rings each comprising an inner and outer conductive perimeter surface and a series of spaced radially extending conductive webs therebetween to divide each of said annular rings into a series of circumferentially disposed waveguide sections, said rings being mounted coaxially in a facing relationship such that said waveguide sections are in electromagnetic communication forming a rotatable interface;

first and second feed means connected to said first and second annular rings, respectively, said feeds having a discrete transmissive line connection to each of said waveguide sections and at least one external port for said antenna from said first feed means and at least one external port for external connection from said second feed means.

2. A rotary coupler according to claim 1 in which said webs form the broad walls of said waveguide sections.

3. A rotary coupler according to claim 1 in which said first and second rings have equal numbers of said waveguide sections.

4. A rotary coupler according to claim 1 in which said first annular ring is structurally associated with said array and, therefore, rotates therewith, and in which said second annular ring is fixed with respect to said vertical support structure, said external connection from said second feed means providing a transmit-receive port for said array.

5. Apparatus according to claim 1 in which said first annular ring and feed means are the rotating annular ring and feed means from said first ring to said antenna array, respectively, and said second annular ring and feed members are the fixed ring and feed means are from said second ring.

6. Apparatus according to claim 4 in which said first feed means comprises a first plurality of discrete ports connected one to each of said waveguide sections of said first annular ring and a second plurality of discrete ports connected one to a discrete column of radiating elements within said array.

7. Apparatus according to claim 4 in which said waveguide sections of said first annular ring are equal in number to the number of vertical columns of radiators in said array, said first feed thereby consisting of a transmission line from each of said waveguide sections in said first annular ring to a corresponding column of said vertical radiators.

8. Apparatus according to claim 7 in which the circumferential widths of said waveguide sections are diminished to reduce the power transfer thereto where such waveguide sections correspond to vertical columns of radiators of said array which are to be energized at reduced power according to a program of amplitude taper over the aperture of said array.

9. Apparatus according to claim 4 in which said first feed means comprises a discrete connection to each of said waveguide sections of said first annular ring and a plurality of second connections, one to a corresponding one of said vertical columns of said array, said first feed comprising power divider/combiner means, the number of said second connections and array columns of radiators being a predetermined, fraction of said waveguide sections, said predetermined fraction being the reciprocal of an integer.

10. Apparatus according to claim 9 in which the circumferential widths of said waveguide sections are diminished to reduce the power transfer thereto where such waveguide sections correspond to vertical columns of radiators of said array which are to be energized at reduced power according to a program of amplitude taper over the aperture of said array.

* * * * *